US005558335A

United States Patent [19]

Wise

[11] Patent Number: 5,558,335

[45] Date of Patent: Sep. 24, 1996

[54] CHESS FOOTBALL GAME

[76] Inventor: Dennis Wise, 222 County Park Rd., Pottstown, Pa. 19465

[21] Appl. No.: 529,329

[22] Filed: Sep. 18, 1995

[51] Int. Cl.[6] ..... A63F 3/00

[52] U.S. Cl. ..... 273/237; 273/261

[58] Field of Search ..... 273/237, 260, 273/261, 242, 247

[56] References Cited

U.S. PATENT DOCUMENTS 5,102,144 4/1992 Dickerman ..... 273/237 X
5,126,717 6/1992 Renaud et al. ..... 273/237 X
5,328,187 7/1994 De Marchi ..... 273/237
5,407,204 4/1995 Meyer ..... 273/237 X

*Primary Examiner*—William E. Stoll

[57] ABSTRACT

A chess football game comprised of a game board having a generally rectangular configuration. The game board has an illuminated playing surface disposed thereon. The illuminated playing surface comprises a chess board with the addition of an end row of squares at opposing ends thereof. The game board has upwardly extending side portions. The game board has an activation button disposed thereon. A power source is secured within the game board. The power source is electrically coupled with the illuminated playing surface.

5 Claims, 3 Drawing Sheets

CHESS FOOTBALL GAME

BACKGROUND OF THE INVENTION

1. Field of the Invention

The present invention relates to a chess football game and more particularly pertains to playing chess with points scored for the capturing of an opponents playing pieces with a chess football game.

2. Description of the Prior Art

The use of chess games is known in the prior art. More specifically, chess games heretofore devised and utilized for the purpose of playing varieties of the game of chess are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,356,152 to Curry discloses a football board game.

U.S. Pat. No. 5,338,041 to Jones et al. discloses a sports chess game apparatus.

U.S. Pat. No. Design 246,999 to Hjelmeland discloses the ornamental design for a chess football board game.

U.S. Pat. No. 5,332,215 to Gonzales discloses a football board game.

U.S. Pat. No. Design 245,718 to Maloney, II discloses the ornamental design for a hockey board game.

U.S. Pat. No. 4,443,011 to Sheridan discloses a method of playing chess football.

While these devices fulfill their respective, particular objective and requirements, the aforementioned patents do not describe a chess football game for playing chess with points scored for the capturing of an opponents playing pieces.

In this respect, the chess football game according to the present invention substantially departs from the conventional concepts and designs of the prior art, and in doing so provides an apparatus primarily developed for the purpose of playing chess with points scored for the capturing of an opponents playing pieces.

Therefore, it can be appreciated that there exists a continuing need for new and improved chess football game which can be used for playing chess with points scored for the capturing of an opponents playing pieces. In this regard, the present invention substantially fulfills this need.

SUMMARY OF THE INVENTION

In the view of the foregoing disadvantages inherent in the known types of chess games now present in the prior art, the present invention provides an improved chess football game. As such, the general purpose of the present invention, which will be described subsequently in greater detail, is to provide a new and improved chess football game and method which has all the advantages of the prior art and none of the disadvantages.

To attain this, the present invention essentially comprises a game board having a generally rectangular configuration. The game board has a hollow interior. The game board has an illuminated playing surface disposed thereon. The illuminated playing surface resembles a chess board with the addition of end lines at opposing ends thereof. The game board has goal posts positioned beyond the end lines of the illuminated playing surface. The game board has upwardly extending side portions. The game board has an activation button disposed thereon. A speaker is secured within one of the upwardly extending side portions of the game board. A scoring system is secured within one of the upwardly extending side portions of the game board opposed from the speaker. A control means is secured within the hollow interior of the game board. The control means has an electrical plug extending outwardly of the game board. The electrical plug is adapted for coupling with an electrical outlet. The control means cooperates with the activation button of the game board. The power means is electrically coupled collectively with the illuminated playing surface, the speaker, and the scoring system.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chess football game which has all the advantages of the prior art chess games and none of the disadvantages.

It is another object of the present invention to provide a new and improved chess football game which may be easily and efficiently manufactured and marketed.

It is a further object of the present invention to provide a new and improved chess football game which is of durable and reliable construction.

An even further object of the present invention is to provide a new and improved chess football game which is susceptible of a low cost of manufacture with regard to both materials and labor, and which accordingly is then susceptible of low prices of sale to the consuming public, thereby making such a chess football game economically available to the buying public.

Still yet another object of the present invention is to provide a new and improved chess football game which provides in the apparatuses and methods of the prior art some of the advantages thereof, while simultaneously overcoming some of the disadvantages normally associated therewith.

Even still another object of the present invention is to provide a new and improved chess football game for playing chess with points scored for the capturing of an opponents playing pieces.

Lastly, it is an object of the present invention to provide a new and improved chess football game comprised of a game board having a generally rectangular configuration. The game board has an illuminated playing surface disposed thereon. The illuminated playing surface resembles a chess board with the addition of end lines at opposing ends thereof. The game board has upwardly extending side portions. The game board has an activation button disposed thereon. A power source is secured within the game board. The power source is electrically coupled with the illuminated playing surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
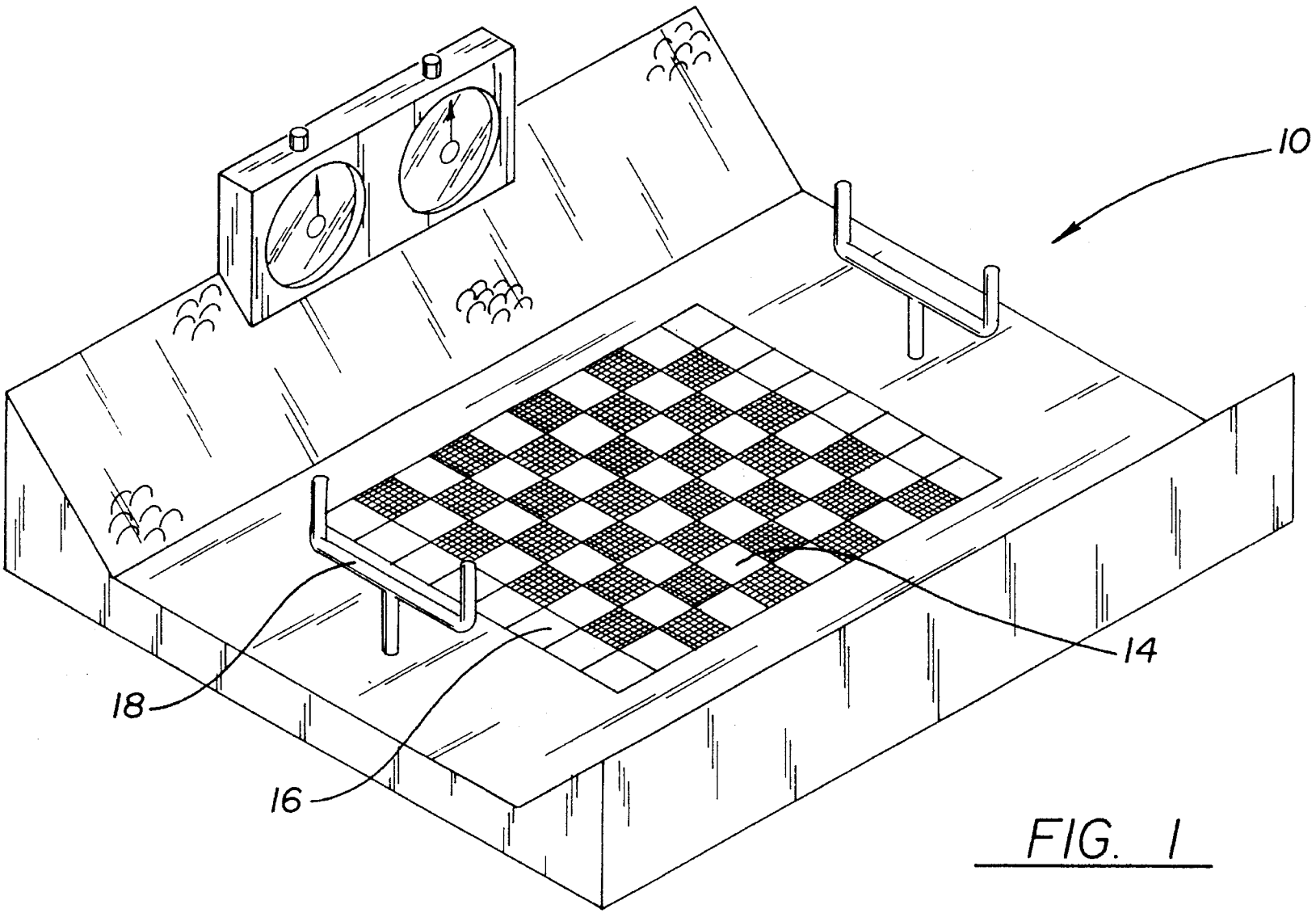
FIG. 1 is a perspective view of the preferred embodiment of the chess football game constructed in accordance with the principles of the present invention.
Figure 2:
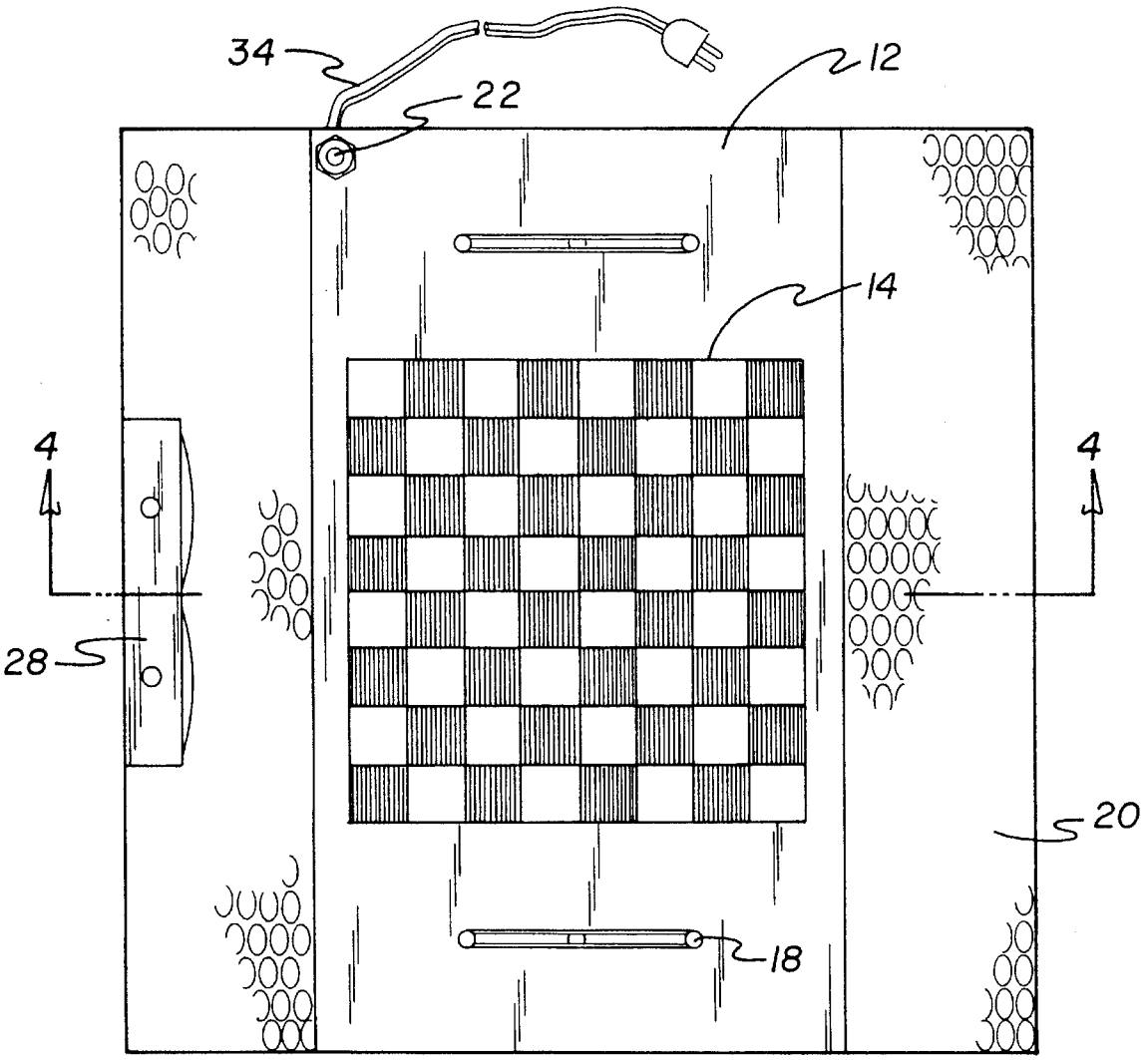
FIG. 2 is a plan view of the preferred embodiment of the present invention.
Figure 3:
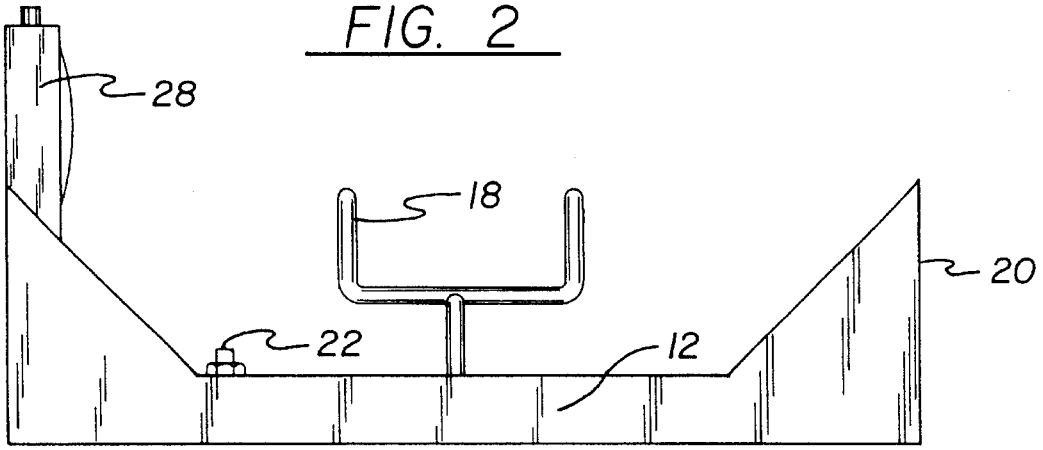
FIG. 3 is a side elevation view of the present invention.
Figure 4:
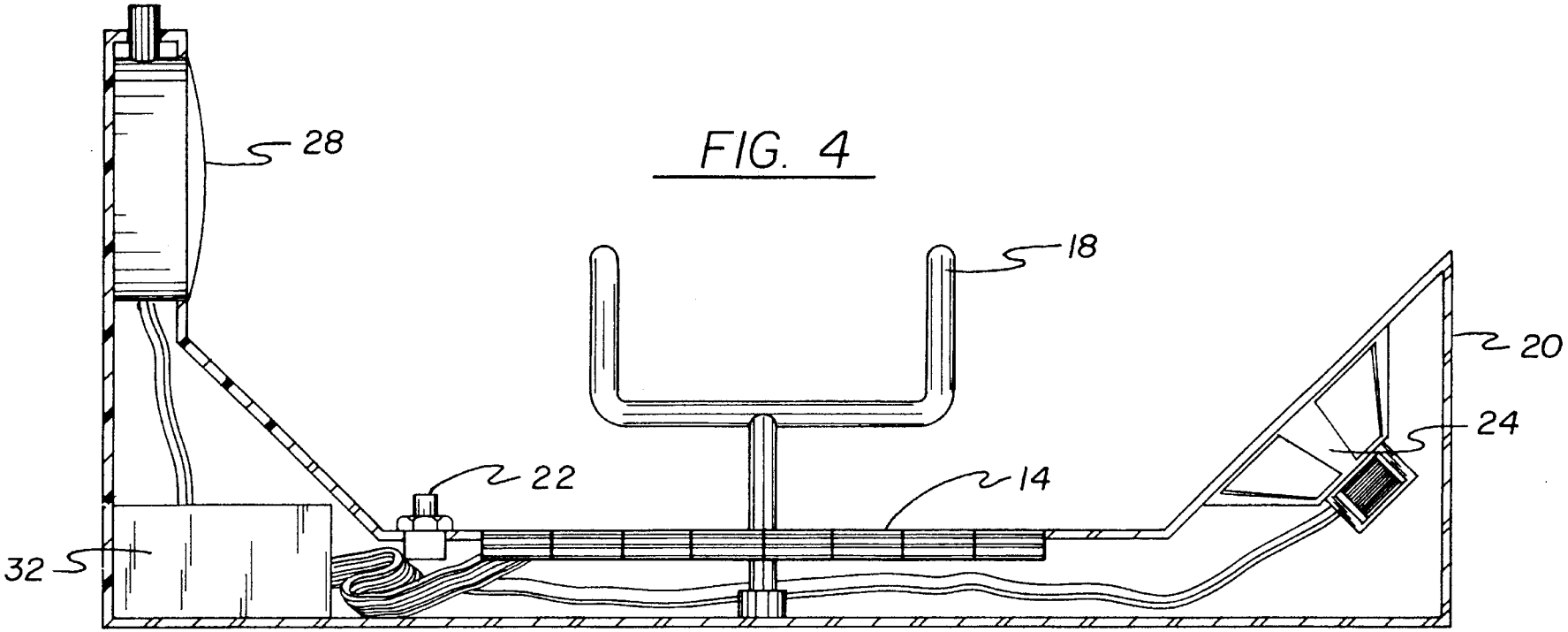
FIG. 4 is a cross-sectional view as taken along line 4—4 of FIG. 2.
Figure 5:
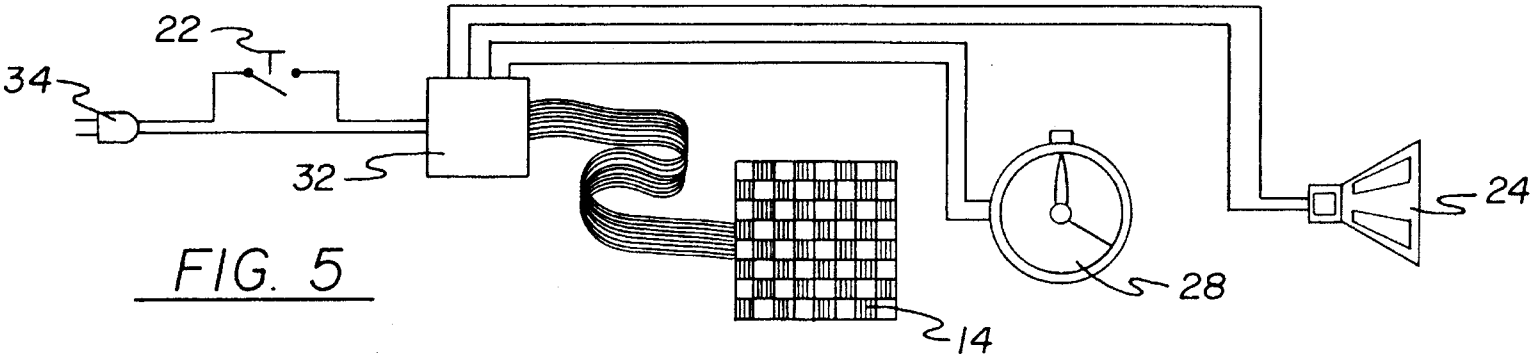
FIG. 5 is a schematical view of the present invention.

With reference now to the drawings, and in particular, to FIG. 1 thereof, the preferred embodiment of the new and improved chess football game embodying the principles and concepts of the present invention and generally designated by the reference number 10 will be described.

Specifically, it will be noted in the various Figures that the device relates to a new and improved chess football game for playing chess with points scored for the capturing of an opponents playing pieces. In its broadest context, the device consists of a game board, a speaker, a scoring system, and a control means. Such components are individually configured and correlated with respect to each other so as to attain the desired objective.

The first component of the device 10 is a game board 12. The game board 12 has a generally rectangular configuration. The game board 12 can be constructed out of molded plastic or of a wood material. The game board 12 has a hollow interior. The game board 12 has an illuminated playing surface 14 disposed thereon. The illuminated playing surface 14 resembles a chess board with the addition of end lines 16 at opposing ends thereof. The game board 12 has goal posts 18 positioned beyond the end lines 16 of the illuminated playing surface 14. The game board 12 has upwardly extending side portions 20. The side portions 20 can be illustrated with people attending a football game seated within a stadium. The game board 12 has an activation button 22 disposed thereon. Playing pieces would be used on the game board similar to chess pieces in function. The playing pieces would be designed in the shape of football players or hockey players in a hockey version of the game. For example, the king would be the quarterback, the queen and bishops would be running backs, the knights would be receivers, the rooks would be linebackers and the pawns would be lineman. The game would be played in the same manner that chess is played, but additionally points would be awarded for the capturing of an opponents pieces. For example, capturing a king would reward eight points, a queen would reward seven points, bishop's, knight's, and rooks would reward three points, and pawns would reward two points. Victory would be judges on the capturing of the king, but if the opponent who's king is captured has more points at the time of capture, a rematch can be requested.

The second component of the device 10 is a speaker 24. The speaker 24 is secured within one of the upwardly extending side portions 20 of the game board 12.

The third component of the device 10 is a scoring system 28. The scoring system 28 is secured within one of the upwardly extending side portions 20 of the game board 12 opposed from the speaker 24. The scoring system 28 is comprised of two scoreboards used to compile the amount of points each player receives while playing the game.

The final component of the device 10 is a control means 32. The control means 32 is secured within the hollow interior of the game board 12. The control means 32 has an electrical plug 34 extending outwardly of the game board 12. The electrical plug 34 is adapted for coupling with an electrical outlet. The control means 32 cooperates with the activation button 22 of the game board 12. The power means 32 is electrically coupled collectively with the illuminated playing surface 14, the speaker 24, and the scoring system 28. Once the electrical plug 34 is inserted into the electrical outlet the activation button is pressed to illuminate the playing surface 14. The control means 32 is programmed to transmit sound effects through the speaker 24. The control means 32 could also be programmed to transmit crowd noises and an announcer's voice to give a sports effect of the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A chess football game for playing chess with points scored for the capturing of an opponents playing pieces comprising, in combination:

a game board having a generally rectangular configuration, the game board having a hollow interior, the game board having an illuminated playing surface disposed thereon, the illuminated playing surface comprising a chess board with the addition of an end row of squares at opposing ends thereof, the game board having goal posts positioned beyond the end lines of the illuminated playing surface, the game board having upwardly extending side portions, the game board having an activation button disposed thereon;

a speaker secured within one of the upwardly extending side portions of the game board;

a scoring system secured within one of the upwardly extending side portions of the game board opposed from the speaker;

a control means secured within the hollow interior of the game board, the control means having an electrical plug extending outwardly of the game board, the electrical plug adapted for coupling with an electrical outlet, the control means cooperating with the activation button of the game board, the power means being electrically coupled collectively with the illuminated playing surface, the speaker, and the scoring system.

2. The game as described in claim 1 wherein the control means being programmed to send audible sounds and voices through the speaker.

3. A chess game for playing chess with points scored for the capturing of an opponents playing pieces comprising, in combination:

a game board having a generally rectangular configuration, the game board having an illuminated playing surface disposed thereon, the illuminated playing surface comprising a chess board with the addition of an end row of squares at opposing ends thereof, the game board having upwardly extending side portions, the game board having an activation button disposed thereon;

a power source secured within the game board, the power source being electrically coupled with the illuminated playing surface.

4. The game as described in claim 3 and further including a speaker secured within one of the upwardly extending side portions of the game board, the speaker being electrically coupled with the power source.

5. The game as described in claim 3 and further including a scoring system secured within one of the upwardly extending side portions of the game board, the scoring system being electrically coupled with the power source.

* * * * *